United States Patent [19]

Yokono et al.

[11] Patent Number: 4,599,076

[45] Date of Patent: Jul. 8, 1986

[54] METHOD OF PRODUCING DISCHARGE DISPLAY DEVICE

[75] Inventors: Shigeru Yokono; Masatoshi Takahashi; Hideo Sato, all of Kanagawa, Japan

[73] Assignee: Sony Corporation, Tokyo, Japan

[21] Appl. No.: 721,955

[22] Filed: Apr. 11, 1985

[30] Foreign Application Priority Data

Apr. 19, 1984 [JP] Japan ..... 59-79216

[51] Int. Cl.[4] ..... H01J 9/12

[52] U.S. Cl. ..... 445/24; 445/51; 313/355; 313/630; 427/77; 427/126.2

[58] Field of Search ..... 445/24, 25, 51; 313/346 R, 355, 630; 427/77, 126.2

[56] References Cited

U.S. PATENT DOCUMENTS 2,172,207 9/1939 Kolligs et al. ..... 427/77 X 4,126,809 11/1978 Wedding et al. ..... 313/587

4,317,750 3/1982 Provance et al. ..... 427/126.2 X 4,393,326 7/1983 Kamegaya et al. ..... 445/24 X 4,429,250 1/1984 Clere et al. ..... 313/346 R 4,554,482 11/1985 Kamegaya et al. ..... 313/630 X

*Primary Examiner*—Kenneth J. Ramsey

*Attorney, Agent, or Firm*—Hill, Van Santen, Steadman & Simpson

[57] ABSTRACT

The present invention discloses a method of producing a discharge display device which enables a $LaB_6$ cathode to be formed by a thick-film printing method. The method of the present invention comprises the steps of applying a paste prepared by mixing $LaB_6$ powder with alkali glass powder in a proportion of 20–40 wt. % with respect to the $LaB_6$ powder to a base electrode, burning the paste, and activating the paste by gas discharge with large current after an exhaustion step to form a $LaB_6$ cathode on the base electrode.

3 Claims, 5 Drawing Figures

METHOD OF PRODUCING DISCHARGE DISPLAY DEVICE

BACKGROUND OF THE INVENTION

1. Field of the Invention

This invention relates to a method of producing a discharge display device and more particularly to a method of forming a $LaB_6$ cathode for the discharge display device.

2. Description of the Prior Art

Recently, development of discharge display devices, especially direct current type XY matrix discharge display panels termed plasma display panel or PDP has been promoted. In such a discharge display panel, Nickel (Ni) is usually used as an anode and a cathode. However, Ni has insufficient resistance against discharge sputtering, and therefore a Ni cathode deteriorates in several seconds of operation. To cope with this, mercury (Hg) has been sealed in the discharge display panel and deposited on a surface of the electrode to suppress sputtering.

On the other hand, a direct current type discharge display panel developed by the present inventors employs a unique driving system, that is, a trigger discharging system, and when it is applied to an XY matrix panel with a large capacity, it is necessary to provide discharge characteristics, (i.e., the characteristics of trigger discharge and main discharge) of each display cell uniform to a certain degree. However, in a discharge display panel having mercury (Hg) sealed therein, a non-uniform distribution of the mercury commonly occurs due to change on tanding, and it is difficult to retain uniform discharge characteristics for a long time. For this reason, it is important to provide a discharge display panel in which no mercury is sealed. Further, for example, where a discharge display panel is to be used in a closed room such as a cockpit, mercury should not be used in consideration of danger.

Further, in the XY matrix type discharge display panel, it is generally important to attain reduction in power consumption, long life, high discharge efficiency and reduced driving voltage, etc. Meanwhile, lathanum boride ($LaB_6$) has been noticed as a cathode material. $LaB_6$ is low in its discharge holding voltage, and is stable in physical and chemical properties, thus meeting the above-mentioned requirements.

However, a $LaB_6$ cathode has not yet reached practical use for the reason that production employing a thin-film evaporation method or a plasma spraying method is complicated and results in increase in cost. Particularly, it is difficult to form a relatively uniform electrode with a large capacity and a large screen. Another reason is that the electrode cannot be formed in connection with the other panel structure by a thick-film printing method with a low cost.

In a case where the $LaB_6$ cathode is intended to be formed by the thick-film printing method, it is generally burnt in an atmosphere of nitrogen of $N_2$ at 800° C.–900° C. after printing and application. However, as a substrate of the discharge display panel is glass, temperature is permitted to be raised up to about 600° C., and as a structure such as the other electrodes and a barrier is oxide, a burning step is usually carried out in the air. For these reasons, it is difficult to form the $LaB_6$ cathode. In addition, $LaB_6$ has a high melting point of about 2300° C., and therefore it cannot be sintered at a temperature of about 600° C., with a result that resistance after formation of the cathode is disadvantageously increased to $10^9$, and more. In the case that the thick-film printing method is adopted, a binder substance such as frit glass is generally mixed with $LaB_6$ powder so as to obtain a bonding strength between particles of the $LaB_6$ powder. However, it is considered not possible to use a mixture of such glass binder with $LaB_6$ powder, due to the resulting high resistance after formation of the $LaB_6$ cathode.

SUMMARY OF THE INVENTION

Accordingly, it is an object of the present invention to provide a method of producing a discharge display device which enables a $LaB_6$ cathode to be formed by a thick-film printing method.

In accordance with the present invention, a method of producing a discharge display device comprises the steps of applying a paste prepared by mixing $LaB_6$ powder with alkali glass powder in a proportion of 20–40 wt. % with respect to the $LaB_6$ powder, to a base electrode, burning the paste, and then activating the paste by gas discharge with large current after an exhaustion step, to form a $LaB_6$ cathode on the base electrode.

According to the method of the present invention, it is possible to easily form a $LaB_6$ cathode by the thick-film printing method, and obtain a discharge display device having improved characteristics such as low driving voltage, long life and high discharge efficiency.

In other words, it is possible to easily form the $LaB_6$ cathode by a so-called thick-film printing method by the steps of applying and printing the $LaB_6$ paste, and subsequently effecting activation treatment by gas discharge with large current.

Further, since the glass binder is contained in the $LaB_6$ paste, a $LaB_6$ cathode having a large adhesive strength may be obtained. Additionally, since an alkali glass powder having ionic conducting property is used as the glass binder, and the alkali glass powder is mixed in a proportion of 20–40 wt. % with respect to $LaB_6$ powder, the activation treatment may be satisfactorily effected.

In accordance with the invention, it is possible to produce a discharge display device with a large capacity and a large area. Further, formation of the $LaB_6$ cathode is simplified as compared with an evaporation method, etc., thus reducing cost.

In this connection, the possibility of formation of the $LaB_6$ cathode imparts the following advantages. That is, driving voltage in the discharge display device may be lowered, and accordingly circuit cost may be reduced by using IC. Power consumption may be reduced. Owing to the fact that $LaB_6$ is superior in anti-sputtering performance, and is stable in physical and chemical properties, and sputter voltage is decreased due to the low driving voltage, life of the discharge display device is extended. High luminance may be achieved by improvement in discharge efficiency and reduction in power consumption. Further, application of this type of discharge display device is expanded owing to elimination of mercury.

DETAILED DESCRIPTION OF THE PREFERRED EMBODIMENT

Figure 1:
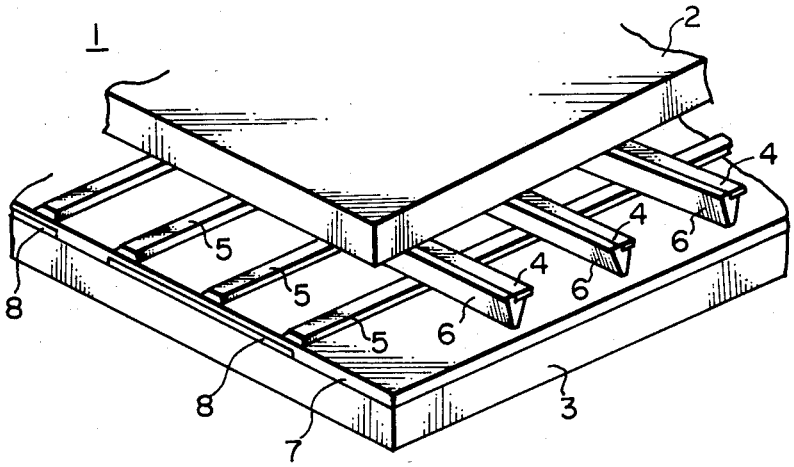
FIG. 1 is a partial perspective view of an exemplary discharge display device employable in accordance with the present invention.

First, an exemplary discharge display device employable in accordance with the present invention will now be described with reference to FIG. 1, in which the discharge display device is applied to a direct current type discharge display panel of a trigger discharge system. There, a discharge panel 1 comprises a front glass substrate 2, a rear glass substrate 3, anodes 4 and cathodes 5 of XY matrix shape. The anodes 4 are partitioned from each other by insulating barriers 6. On the rear glass substrate 3, trigger electrodes 8, formed of aluminum (Al) for example, are arranged in parallel relation with the cathodes 5 through an insulated dielectric layer 7 under the cathodes 5.

The display panel 1 is manufactured in the following manner. First, the anodes 4 and the insulating barriers 6 are formed on the front glass substrate 2 by a thick-film printing method. Similarly, the trigger electrodes 8, the insulated dielectric layer 7 and the cathodes 5 are sequentially formed on the rear glass substrate 3 by the thick-film printing method. Each of these constitutional parts is burnt after printing. Then, both the glass substrates 2 and 3 are oppositely arranged with the anodes 4 and the cathodes 5 cross at a right angle, and are frit-sealed about the periphery. Thereafter, heating exhaustion, gas sealing (e.g., Ne-Ar ga) and final sealing are carried out to complete the display panel 1.

In such a discharge display panel 1 as obtained above, a driving voltage is selectively applied to the anodes 4 and the cathodes 5 to generate discharge luminescence at cross-points between the selected anodes 4 and cathodes 5, thereby effecting display in a linearly sequential manner. Especially, in this display panel 1, a trigger voltage is applied to the trigger electrodes 8 prior to effecting of discharge between the anodes 4 and the cathodes 5 to induce a wall voltage on a portion of the insulated dielectric layer 7 corresponding to the trigger electrodes 8 and effect momentary discharge between the insulated dielectric layer 7 and the selected cathodes 5. As a result, a gas space along the cathodes 5 is ionized, so that subsequent discharge between the selected anodes 4 and cathodes 5 may be easily effected.

The present invention is directed to a method of forming the cathodes 5 in the discharge display panel by the thick-film printing method. A preferred embodiment of the present invention will be described below.

In the present invention, $LaB_6$ paste consisting of $LaB_6$ powder, inorganic binder and suitable vehicle (solvent) is preliminarily prepared. The $LaB_6$ powder as a raw material is selected in such a manner that an average particle size thereof is to be not more than several $\mu$m, preferably 1–3 $\mu$m, and powder having the average particle size of not less than 5 $\mu$m is to be contained in a proportion of not more than 5% with respect to the total amount of $LaB_6$ powder. As the $LaB_6$ powder is sufficiently unbound from its sintered state in general, it is further finely pulverized with a ball mill. As the inorganic binder, an alkali glass is used, because a certain degree of ionic conduction is required in a subsequent activation step. A fine powder of the alkali glass is added in the amount of 0.2–0.4 parts by weight with respect to 1 part by weight of the $LaB_6$ powder. If the amount of the alkali glass fine powder is too small, activation is rendered non-uniform, while if it is too much, the activation is difficult to effect.

Figure 2A:
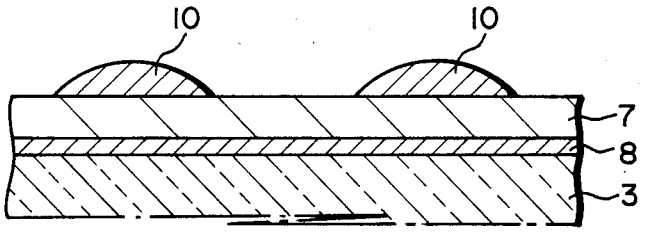
FIG. 2A to 2C are exemplary illustrations, in cross-section, of formation of $LaB_6$ cathode according to the present invention.

As shown in FIG. 2A, first a conductive paste such as Nickel (Ni) paste is applied and printed along a cathode pattern to be formed on the insulated dielectric layer 7 formed on the rear glass substrate 3, and is burnt to form Ni base electrodes 10. The Ni base electrodes 10 serve as a lead wire for supplying current to a $LaB_6$ cathode which will be subsequently formed.

Figure 2B:
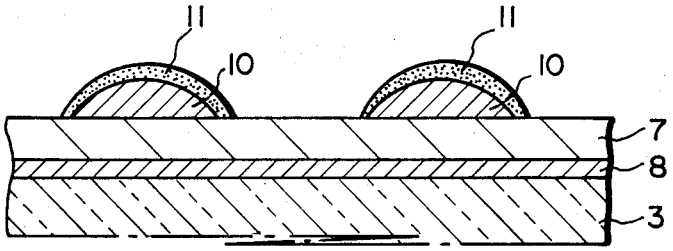

Then, as shown in FIG. 2B, the $LaB_6$ paste as mentioned above is printed on the Ni base electrodes 10, and is then burnt in a dry air at 500°–600° C. for 30 min. to for a $LaB_6$ layer 11. The resistance after being burnt is rendered high, namely, not less than $10^9\Omega$.

Figure 2C:
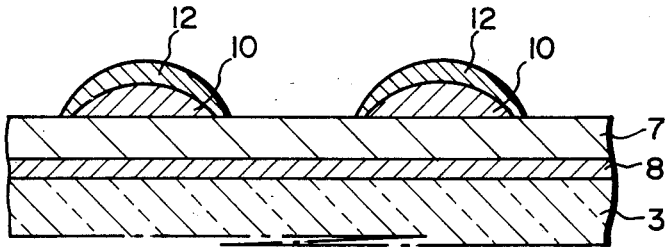

Then, the front glass substrate 2 on which the nodes 4, formed of Ni for example, and the barriers 6 are formed as mentioned above and the rear glass substrate 3 are frit-sealed around the edges, and heating exhaustion, sealing of desired gas and final sealing are carried out. Thereafter, a predetermined voltage is applied between the anodes 4 and the Ni base electrodes 10 to effect activation treatment by gas discharge with a large current (cathode forming). With this activation treatment, no glass becomes present on the $LaB_6$ layer 11 (socalled discharge surface), and $LaB_6$ itself is exposed to the discharge surface. Furthermore, sintering of $LaB_6$ powders occurs owing to a local thermal effect to make the surface of the $LaB_6$ layer in a fused and bound condition. As a result, electrical continuity is provided to reduce the resistance in the $LaB_6$ layer. Thusly, as shown in FIG. 2C, a $LaB_6$ cathode 12 is formed on the Ni base electrode 10.

Figure 3:
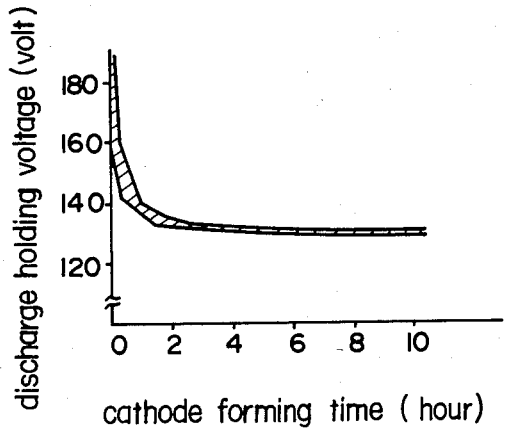
FIG. 3 is a graph showing change in a holding voltage during activation treatment.

A current density during activation is about 2–5 $A/cm^2$ . FIG. 3 shows change in a holding voltage during activation, provided that the activation treatment is carried out at a current density of 3 $A/cm^2$ with 0.5 sec ON–0.5 sec OFF set, As will be apparent from FIG. 3, at an initial stage, a firing potential is high (200 V and over), and dispersion is large. However, as time is elapsed, the firing potential is lowered and is stabilized in 2–3 hours. Further, dispersion becomes small after about one hour has elapsed.

The holding voltage in a normally driving region after activation is about 110 V. Comparatively, in case of Ni cathode; the holding voltage is about 150 V.

According to the method of the present invention, the $LaB_6$ paste is applied and printed to the base electrode, and is burnt, thereafter carrying out activation by gas discharge with large current after an exhaustion step, thereby permitting the $LaB_6$ cathode to be formed by a so-called thick-film printing method. Since the $LaB_6$ paste contains a glass binder, both the bonding strength between each of the $LaB_6$ cathodes and the base electrode are large, and the $LaB_6$ cathodes are not easily separated even if they are slightly rubbed during the frit sealing step. Furthermore, since the alkali glass having ionic conducting property is used as the glass binder, the subsequent activation treatment may be securely effected. Additionally, since the $LaB_6$ paste layer is burned in the air at about 500°–600° C., the rear glass substrate is not damaged, and the other structures of oxide are not badly influenced.

Although the preferred embodiment as mentioned above is applied to the direct current type discharge display panel of trigger discharge system, it will be appreciated that the present invention is applicable to formation of the $LaB_6$ cathode for the other discharge display panels.

I claim as my invention:

1. A method of producing a discharge display device comprising the steps of applying a paste prepared by mixing $LaB_6$ powder with alkali glass powder in a proportion of 20–40 wt. % of glass powder with respect to the $LaB_6$ powder, to a base electrode, burning the paste, and activating the paste by gas discharge with large current following an exhaustion step to form a $LaB_6$ cathode on said base electrode.

2. The method of claim 1 wherein the paste is formed in dry air at a temperature of about 500°–600° C. for a period of about 30 minutes.

3. The method set forth in claim 1 wherein said large current is in the range of 2–5 amps per square centimeters.

* * * * *